US008388389B2

(12) United States Patent
Costello et al.

(10) Patent No.: US 8,388,389 B2
(45) Date of Patent: Mar. 5, 2013

(54) ELECTRICAL CONNECTORS HAVING OPPOSING ELECTRICAL CONTACTS

(75) Inventors: Brian Patrick Costello, Scotts Valley, CA (US); David Patrick Orris, Middletown, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 68 days.

(21) Appl. No.: 13/178,023

(22) Filed: Jul. 7, 2011

(65) Prior Publication Data

US 2013/0012072 A1 Jan. 10, 2013

(51) Int. Cl.
*H01R 4/48* (2006.01)

(52) U.S. Cl. ..... 439/839; 439/637

(58) Field of Classification Search ..... 439/669.1, 439/699.2, 691, 839, 833, 636, 637
See application file for complete search history.

(56) References Cited

U.S. PATENT DOCUMENTS 4,975,066 A * 12/1990 Sucheski et al. ..... 439/699.1
5,431,576 A 7/1995 Matthews
5,618,187 A 4/1997 Goto
7,011,548 B2 * 3/2006 Bogiel et al. ..... 439/856
7,581,972 B2 9/2009 Daamen
7,766,706 B2 * 8/2010 Kawamura et al. ..... 439/839
2002/0119704 A1 * 8/2002 Ito et al. ..... 439/637

OTHER PUBLICATIONS

"Pluggable Bus Bar Connector with high current contacts Crown Clip Junior" 114—19128 Dec. 23, 2010 Rev. A; Tyco Electronics, 8 pgs.

* cited by examiner

*Primary Examiner* — Felix O Figueroa

(57) ABSTRACT

Electrical connector that includes a pair of electrical contacts. Each of the electrical contacts has a mounting portion and a flexible mating portion that is configured to electrically engage a conductive component. The mating portions of the electrical contacts are separated by a component-receiving space and oppose each other across the component-receiving space. The electrical connector also includes a spring clip that is configured to mechanically engage the mating portions and is movable with respect to the mounting portions. The spring clip has a pair of opposing clip arms and a bridge member that joins the clip arms. The clip arms are separated by a gap with the mating portions positioned therebetween. The clip arms are biased against the corresponding mating portions. The spring clip has a dielectric member that is positioned to electrically isolate at least one of the electrical contacts.

20 Claims, 5 Drawing Sheets

ELECTRICAL CONNECTORS HAVING OPPOSING ELECTRICAL CONTACTS

BACKGROUND OF THE INVENTION

The subject matter described and/or illustrated herein relates generally to electrical connectors that have opposing electrical contacts configured to engage opposite sides of a conductive component.

In some electrical systems, power is delivered to a circuit board or other electrical component through a busbar and a busbar connector. A busbar typically comprises a planar strip of conductive material (e.g., copper) having opposite sides which are engaged by the busbar connector. Existing busbar connectors include a housing that holds two mating contacts that oppose each other with a space therebetween. When the busbar is inserted into the space, each of the mating contacts electrically engages a corresponding side of the busbar. In some connectors, the mating contacts are configured to adjust if the busbar is inserted into the space in a misaligned manner. For instance, when the busbar is misaligned, the busbar may press against a first mating contact with more force than a second mating contact that opposes the first mating contact. In such cases, the connector may include a mechanism for adjusting the mating contacts within the housing so that both of the mating contacts sufficiently engage the busbar. However, in known busbar connectors that include such adjustment mechanisms, the mating contacts are electrically connected to each other within the connector housing. As such, the mating contacts are electrically common and unable to carry different currents and operate at different voltages.

Accordingly, there is a need for an electrical connector having opposing mating contacts that are electrically independent and that can accommodate a conductive component (e.g., a busbar) which is engaged to the connector in a misaligned manner.

BRIEF DESCRIPTION OF THE INVENTION

In one embodiment, an electrical connector is provided that includes a pair of electrical contacts. Each of the electrical contacts has a mounting portion that is configured to be mounted to an electrical element and a flexible mating portion that is configured to electrically engage a conductive component. The mating portions of the electrical contacts are separated by a component-receiving space and oppose each other across the component-receiving space. The electrical connector also includes a spring clip that is configured to mechanically engage the mating portions of the electrical contacts and is movable with respect to the mounting portions. The spring clip has a pair of opposing clip arms and a bridge member that joins the clip arms. The clip arms are separated by a gap with the mating portions positioned therebetween. The clip arms are biased against the corresponding mating portions. The spring clip has a dielectric member that is positioned between the spring clip and at least one of the electrical contacts to electrically isolate the spring clip from said at least one of the electrical contacts.

In another embodiment, an electrical connector is provided that includes a connector housing having an interior cavity and a socket opening that provides access to the interior cavity. The socket opening is configured to receive a conductive component. The electrical connector also includes a pair of electrical contacts that are positioned in the interior cavity. Each of the electrical contacts has a flexible mating portion that is configured to electrically engage the conductive component proximate to the socket opening. The mating portions are separated by a component-receiving space and oppose each other across the component-receiving space. The electrical connector also includes a spring clip that is configured to mechanically engage the mating portions of the electrical contacts. The spring clip has a pair of opposing clip arms and a bridge member that joins the clip arms. The clip arms are biased against the mating portions located between the clip arms. The spring clip has a dielectric member that is positioned between the spring clip and at least one of the electrical contacts to electrically isolate the spring clip from said at least one of the electrical contacts.

DETAILED DESCRIPTION OF THE INVENTION

Figure 1:
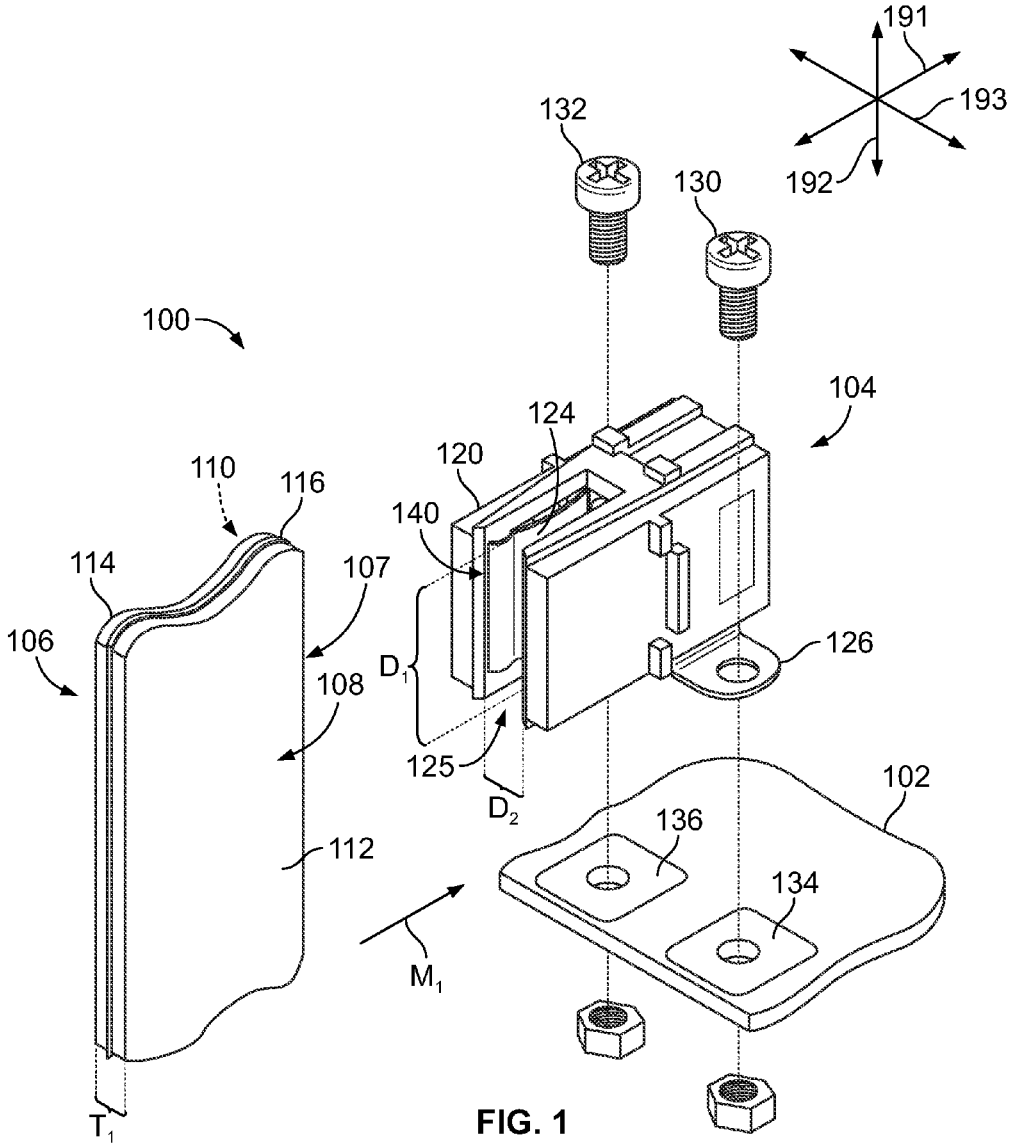
FIG. 1 is an exploded perspective view of an electrical system formed in accordance with one embodiment.

FIG. 1 is an exploded view of an electrical system 100 formed in accordance with one embodiment. As shown, the electrical system 100 includes an electrical element 102 (e.g., a circuit board), an electrical connector 104 that is configured to be mounted to the electrical element 102, and a conductive component 106 that is configured to communicatively engage the electrical connector 104. The conductive component 106 includes a leading edge 107 that is configured to be received by the electrical connector 104. In an exemplary embodiment, the conductive component 106 is a busbar and the electrical connector 104 includes electrical contacts 122 (shown in FIG. 2) and 124 that are configured to transmit electrical power therethrough. However, in other embodiments, the conductive component 106 may be, for example, a card connector and the electrical connector 104 may have electrical contacts configured to transmit data signals therethrough. The conductive component 106 could also be a printed circuit board with multiple conductive layers including two outer conductive layers that face in opposite directions. As shown, the electrical system 100 and the electrical connector 104 are oriented with respect to mutually perpendicular axes 191-193 that include a longitudinal axis 191, an elevation (or vertical) axis 192, and a lateral (or horizontal) axis 193. Although in some embodiments the elevation axis 192 may extend along a gravitational force direction, embodiments described herein are not required to have any particular orientation with respect to gravity.

The conductive component 106 also has a pair of sides 108, 110 and a thickness $T_1$ extending therebetween. The sides 108, 110 face in opposite directions along the lateral axis 193. The conductive component 106 is configured to be electrically engaged to the electrical connector 104 on each side 108, 110. In particular embodiments, the conductive component 106 comprises a busbar having multiple layers including power layers 112, 114 and a dielectric layer 116 that is located between the power layers 112, 114. The power layer 112 includes the side 108, and the power layer 114 includes the side 110. In an exemplary embodiment, the power layers 112, 114 are electrically independent and capable of having different voltages. In some embodiments, the conductive component 106 may have separate electrical contacts (e.g., contact pads) along the sides 108, 110 that are capable of transmitting data signals. In an exemplary embodiment, the electrical contacts 122, 124 are also electrically independent and capable of operating at different voltages.

The electrical connector 104 includes a connector housing 120 having an interior cavity 125 and a socket opening 140 that provides access to the interior cavity 125. The pair of electrical contacts 122, 124 is disposed within the interior cavity 125. The electrical contacts 122, 124 may include respective mounting portions 126, 128 (shown in FIG. 3). In the illustrated embodiment, the mounting portions 126, 128 are configured to be directly coupled to the electrical element 102 using fasteners 130, 132. The mounting portions 126, 128 establish an electrical connection with the electrical element 102 through mounting contacts 134, 136. In other embodiments, the electrical contacts 122, 124 may be coupled to the electrical element 102 in other manners. For example, the mounting portions 126, 128 may include compliant pins or tails that are inserted into plated thru-holes of the electrical element 102 when the electrical element 102 is a circuit board. The mounting portions 126, 128 may also be indirectly coupled to, for example, another electrical connector or different conductive pathways.

In an exemplary embodiment, the conductive component 106 has an elongated and substantially rectangular-shaped body that is configured to be gripped on both sides 108, 110 by the electrical connector 104. For example, the sides 108 and 110 have surfaces that coincide with respective planes that extend along the longitudinal and elevation axes 191, 192 and are parallel to each other. In the illustrated embodiment, the socket opening 140 has an elongated dimension $D_1$ that is measured along the elevation axis 192 and a short dimension $D_2$ that is measured along the lateral axis 193. The dimension $D_2$ is sized to accommodate the thickness $T_1$ of the conductive component 106. Accordingly, the socket opening 140 is configured to receive the conductive component 106 when the leading edge 107 of the conductive component 106 is advanced into the socket opening 140 along a mating direction $M_1$. The mating direction $M_1$ extends substantially parallel to the longitudinal axis 191.

Figure 2:
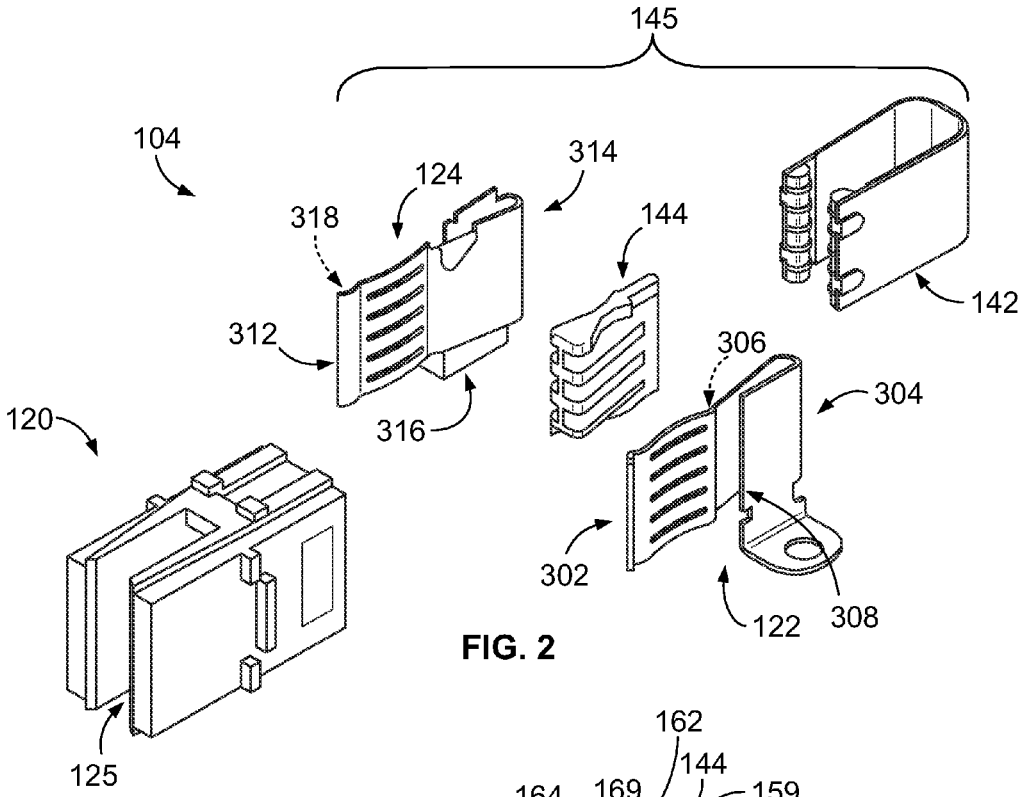
FIG. 2 is an exploded perspective view of an electrical connector formed in accordance with one embodiment that may be used with the electrical system of FIG. 1.
Figure 3:
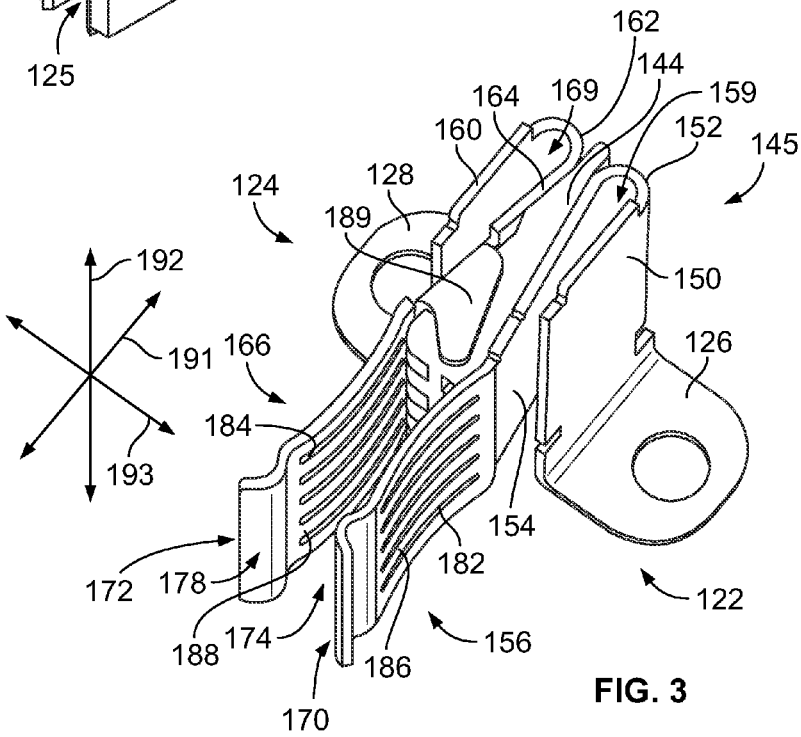
FIG. 3 is an isolated view of a contact assembly that may be used with the electrical connector of FIG. 2.

FIG. 2 is an exploded perspective view of the electrical connector 104, and FIG. 3 is a perspective view of a contact assembly 145 that is used with the electrical connector 104. In an exemplary embodiment, the electrical connector 104 includes the connector housing 120 (FIG. 2) and the contact assembly 145. The contact assembly 145 is configured to be disposed within the interior cavity 125 (FIG. 2) of the connector housing 120. The contact assembly 145 includes the electrical contacts 122, 124, an insulative partition 144 between the electrical contacts 122, 124, and a spring clip 142. (For illustrative purposes, the spring clip 142 of the contact assembly 145 is not shown FIG. 3.)

As shown in FIG. 2, the electrical contact 122 extends longitudinally between front and rear ends 302, 304 and has inner and outer surfaces 306, 308 that face in opposite directions along the lateral axis 193 (FIG. 1). The electrical contact 124 also extends longitudinally between front and rear ends 312, 314 and has inner and outer surfaces 316, 318 that face in opposite directions. When the electrical connector 104 is assembled, the inner surfaces 306, 316 face each other and have the insulative partition 144 located therebetween. The spring clip 142 may be configured to surround the electrical contacts 122, 124 such that the outer surfaces 308, 318 face the spring clip 142. The spring clip 142 is configured to mechanically engage the outer surfaces 308, 318. As will be described in greater detail below, the spring clip 142 includes at least one dielectric member (e.g., an insulative partition, dielectric pad(s) and/or insulative layer(s)) that electrically isolates the electrical contacts 122, 124 from each other.

As shown in FIG. 3, the electrical contact 122 includes the mounting portion 126 that is configured to be mounted to the electrical element 102 (FIG. 1). The electrical contact 122 may also include other contact segments or portions, such as a base portion 150, a joint portion 152, a body portion 154, and a mating portion 156. In the illustrated embodiment, the electrical contact 122 is stamped from sheet material and formed or shaped to include the mounting portion 126, the base portion 150, the joint portion 152, the body portion 154, and the mating portion 156. As such, the electrical contact 122 may be one continuous piece that comprises a common conductive material throughout. However, in alternative embodiments, the electrical contact 122 may include multiple components that are mechanically and electrically coupled together. For example, the base portion 150 and the mating portion 156 may be separate pieces that are electrically joined within the connector housing 120. Also, the electrical contact 122 may include fewer or more portions and/or may have some of the portions combined together.

As shown in the illustrated embodiment, the base portion 150 extends away from the mounting portion 126 in a perpendicular manner. More specifically, the base portion 150 may be oriented to extend parallel to the longitudinal and elevation axes 191, 192. The body portion 154 (or the mating portion 156) is joined to the base portion 150 through the joint portion 152. For example, the joint portion 152 initially extends away from the base portion 150 in a rearward direction along the longitudinal axis 191. The joint portion 152 then folds over and extends toward the body portion 154 (or the mating portion 156). The body portion 154 extends generally along the longitudinal axis 191 in a forward direction toward the mating portion 156. In the illustrated embodiment, an intra-spacing 159 separates the body portion 154 and the base portion 150. The joint portion 152 permits the body portion 154 to move to and from the base portion 150 thereby changing a size of the intra-spacing 159.

The electrical contact 124 may be similar to the electrical contact 122 such that the electrical contacts 122, 124 have substantially symmetrical bodies. For example, in addition to the mounting portion 128, the electrical contact 124 may also include other contact segments or portions, such as a base portion 160, a joint portion 162, a body portion 164, and a mating portion 166. The base and body portions 160, 164 may also be separated by an intra-spacing 169 that is configured to change when the body portion 164 is flexed.

As shown in FIG. 3, the mating portion 156 extends generally along the longitudinal axis 191 from the body portion 154 to an end portion 170. For example, the mating portion 156 may arc inward toward the mating portion 166 and then arc away from the mating portion 166 to the end portion 170. The mating portion 166 may also extend generally along the longitudinal axis 191 from the body portion 164 to an end portion 172. In an exemplary embodiment, the mating portions 156, 166 have respective slits or grooves 182, 184 that extend longitudinally along the mating portions 156, 166. The slits 182, 184 define contact strips 186, 188 of the mating portions 156, 166.

When the electrical contacts 122, 124 are positioned adjacent to each other within the connector housing 120 (FIG. 1), a cavity space 180 (referenced in FIG. 8) exists between the electrical contacts 122, 124 and extends from the joint portions 152, 162 to the end portions 170, 172. As shown in FIG. 3, the insulative partition 144 is located within the cavity space 180 and separates the body portions 154, 164. The cavity space 180 includes a component-receiving space 174 (FIG. 8) that is configured to receive the conductive component 106 (FIG. 1). The mating portions 156, 166 are separated by the component-receiving space 174 and oppose each other across the component-receiving space 174. In FIG. 3, the mating portions 156, 166 are in unengaged or idle positions. The mating portions 156, 166 are flexible and configured to flex to and from the component-receiving space 174 (i.e., the mating portions 156, 166 are configured to flex bi-directionally along the lateral axis 193).

In some embodiments, the end portions 170, 172 are shaped to initially engage the conductive component 106 when the conductive component 106 is mated with the electrical connector 104 (FIG. 1). For example, each of the end portions 170, 172 is shaped to have a hook or C-shaped contour. The end portions 170, 172 include respective spark surfaces 176 (FIG. 8) and 178 that are configured to initially engage the conductive component 106 when the conductive component 106 is advanced into the component-receiving space 174. The spark surfaces 176, 178 may also be the last to disengage with the conductive component 106 when the conductive component 106 is removed from the conductive-receiving space 174.

The electrical contacts 122, 124 may hold the insulative partition 144 between each other. As shown in FIG. 3, the electrical contact 124 may include a grip element 189 that extends into the cavity space 180 toward the electrical contact 122. The grip element 189 is configured to engage a top surface of the insulative partition 144. Although not shown in the Figures, the electrical contact 122 may also include a grip element that extends inward toward the electrical contact 124 and is configured to engage a bottom surface of the insulative partition 144. In an exemplary embodiment, the grip element 189 and the grip element of the electrical contact 122 cooperate in retaining the insulative partition 144 within the interior cavity 125 (FIG. 1) of the connector housing 120.

Figure 5:
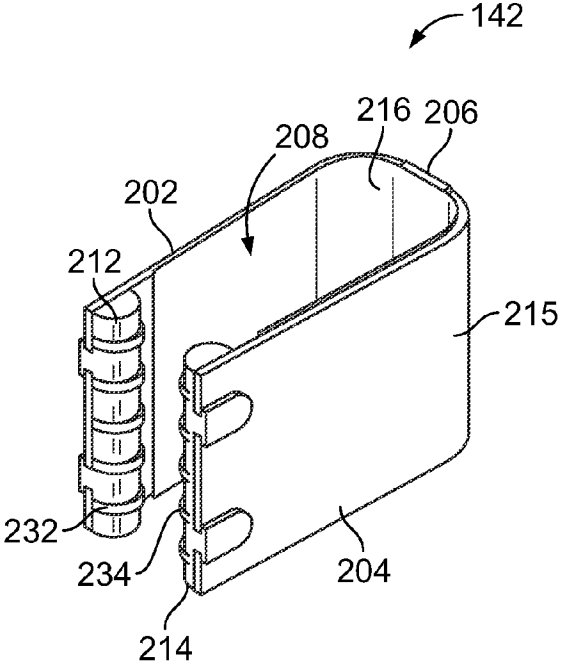
FIG. 5 is an isolated view of the assembled spring clip of FIG. 4.
Figure 4:
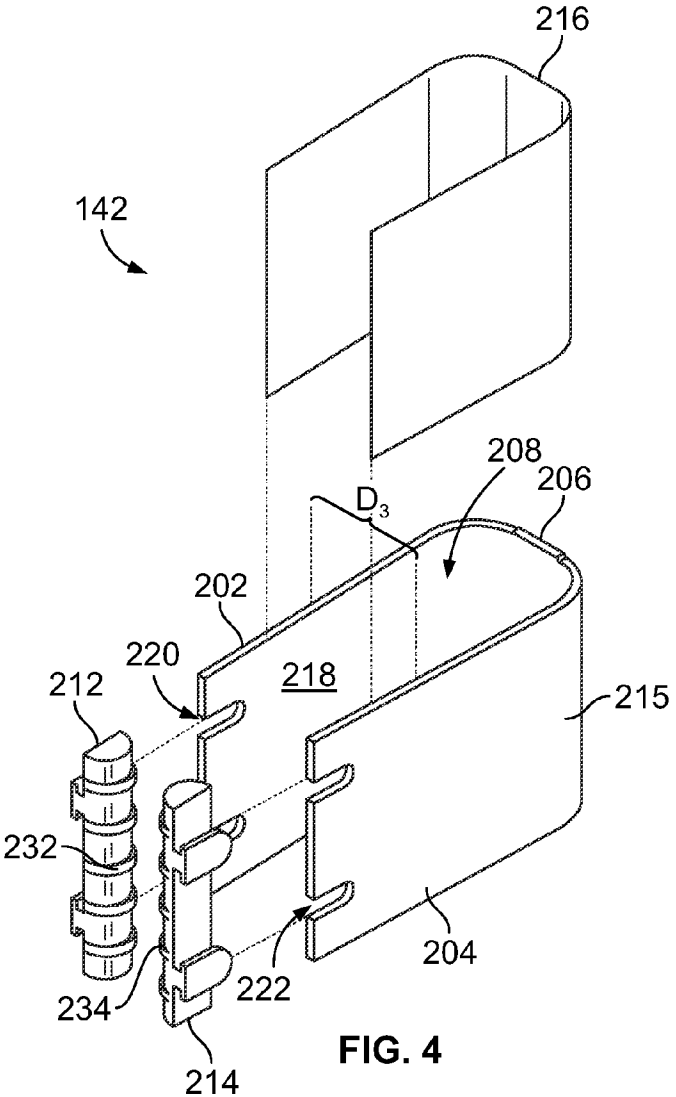
FIG. 4 is an exploded perspective view of a spring clip that may be used with the electrical connector of FIG. 2.

FIGS. 4 and 5 illustrate exploded and assembled views, respectively, of the spring clip 142. In an exemplary embodiment, the spring clip 142 has a pair of opposing clip arms 202, 204 and a bridge member 206 that joins the clip arms 202, 204. The clip arms 202, 204 are separated by a gap 208. The gap 208 has a dimension $D_3$ measured along the lateral axis 193 (FIG. 1) that is sized to permit the electrical contacts 122, 124 (FIG. 2) to be located therebetween. In the illustrated embodiment, the spring clip 142 has a clip body 215 that includes the clip arms 202, 204 and the bridge member 206. The clip body 215 may be stamped from sheet material and formed to include the clip arms 202, 204 and the bridge member 206. The clip body 215 is substantially rigid or inflexible so that the clip arms 202, 204 are predisposed or biased in predetermined positions with respect to each other. For example, the sheet material may be a rigid metal, such as steel. In other embodiments, the clip body 215 is formed from other materials that are sufficiently rigid for carrying out the functions of the spring clip 142 described herein.

In an exemplary embodiment, the spring clip 142 has at least one dielectric member that is configured to electrically isolate the electrical contacts 122, 124 (FIG. 2) from each other. In other words, the spring clip 142 is configured to prevent an electrical pathway from being formed between the electrical contacts 122, 124 through the clip body 215. For example, the clip arms 202, 204 may include respective dielectric pads. A first dielectric pad 212 is disposed on the clip arm 202 and extends toward the mating portion 166 (FIG. 3) when the electrical connector 104 (FIG. 1) is assembled. A second dielectric pad 214 is disposed on the clip arm 204 and extends toward the mating portion 156 (FIG. 3). The dielectric pads 212, 214 may include respective ridges or projections 232, 234 that are configured to engage the mating portions 156, 166 (FIG. 3), respectively. In the illustrated embodiment, the dielectric pads 212, 214 are molded pieces that are attached to the clip arms 202, 204. The dielectric pads 212, 214 may form respective close running fits with recesses (e.g., notches) 220, 222 (FIG. 4) in the clip arms 202, 204. However, the dielectric pads 212, 214 may also be thin layers that are anodized onto the clip arms 202, 204 through, for example, a hard-coat anodizing process. Alternatively, the dielectric pads 212, 214 may be coupled to the clip arms 202, 204 using an adhesive. The dielectric pads 212, 214 can also be applied onto the metal clip arms 202, 204 as an insulative coating such as hard coat anodizing or powder coating.

Also shown, the spring clip 142 may have an insulative layer 216 that is attached to an interior surface 218 (FIG. 4) of the clip body 215. The insulative layer 216 may be coupled to the clip body 215 using, for example, an adhesive. The insulative layer 216 may also be attached to the clip body 215 using a deposition process, such as a hard-coat anodizing process. In an exemplary embodiment, the insulative layer 216 comprises a polyimide film (e.g., Kapton® developed by DuPont). In other embodiments, the insulative layer 216 may be held by the clip body 215 through a frictional fit.

Returning to FIG. 2, the electrical connector 104, in one embodiment, may be assembled by securing the electrical contacts 122, 124 to the electrical element 102 (FIG. 1) with the insulative partition 144 located between the electrical contacts 122, 124. The connector housing 120 may then be moved so that the electrical contacts 122, 124 are inserted into the interior cavity 125 through a rear opening 240 (FIG. 6) of the connector housing 120. Alternatively, the connector housing 120 may be lowered onto electrical contacts 122, 124 so that the electrical contacts 122, 124 are received through a bottom opening (not shown).

Figure 7:
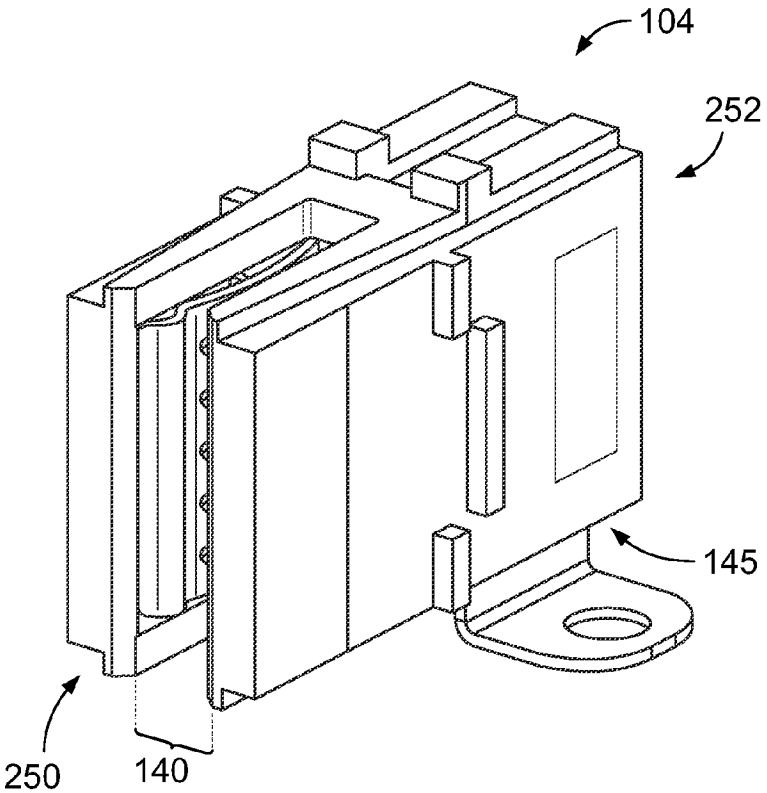
FIG. 7 is a front perspective view of the electrical connector of FIG. 2.
Figure 6:
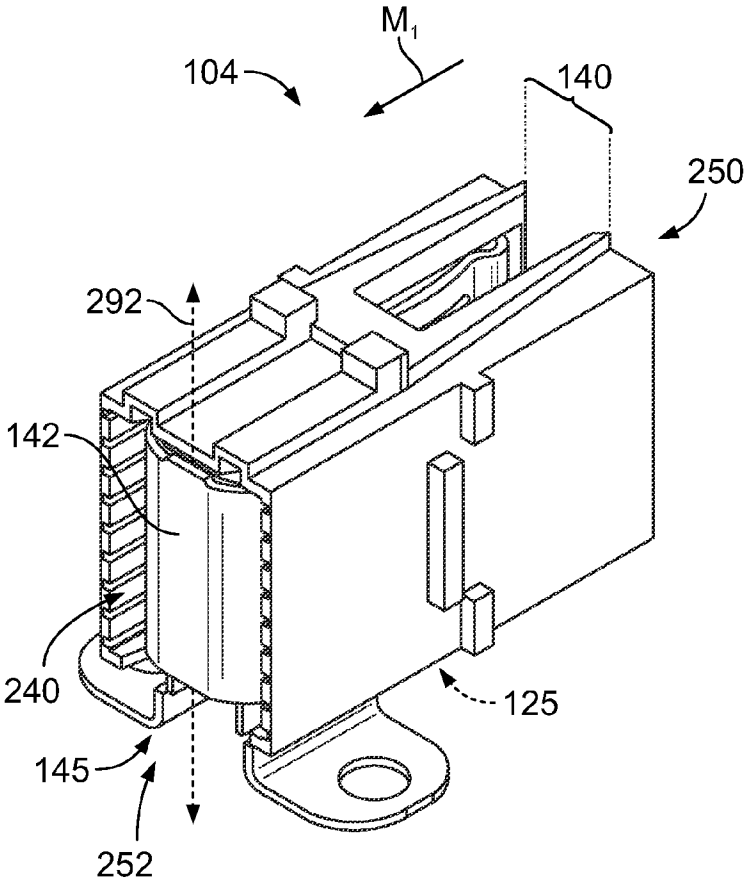
FIG. 6 is a rear perspective view of the electrical connector of FIG. 2.

FIGS. 6 and 7 illustrate rear and front perspective views, respectively, of the fully assembled electrical connector 104. As shown, the electrical connector 104 includes a mating end 250 that is configured to engage the conductive component 106 (FIG. 1). The mating end 250 includes the socket opening 140 that is sized and shaped to receive the conductive component 106. The electrical connector 104 also includes a loading end 252 that is configured, in some embodiments, to receive the contact assembly 145 through the rear opening 240 (FIG. 6).

With reference to FIG. 6, the interior cavity 125 is sized and shaped relative to the spring clip 142 to permit the spring clip 142 to float or move therein. More specifically, when the electrical connector 104 is in operation, the spring clip 142 may rotate about an axis of rotation 292 that extends parallel to the elevation axis 192 (FIG. 1) and proximate to the loading end 252. The axis of rotation 292 extends perpendicular to the mating direction $M_1$.

Figure 8:
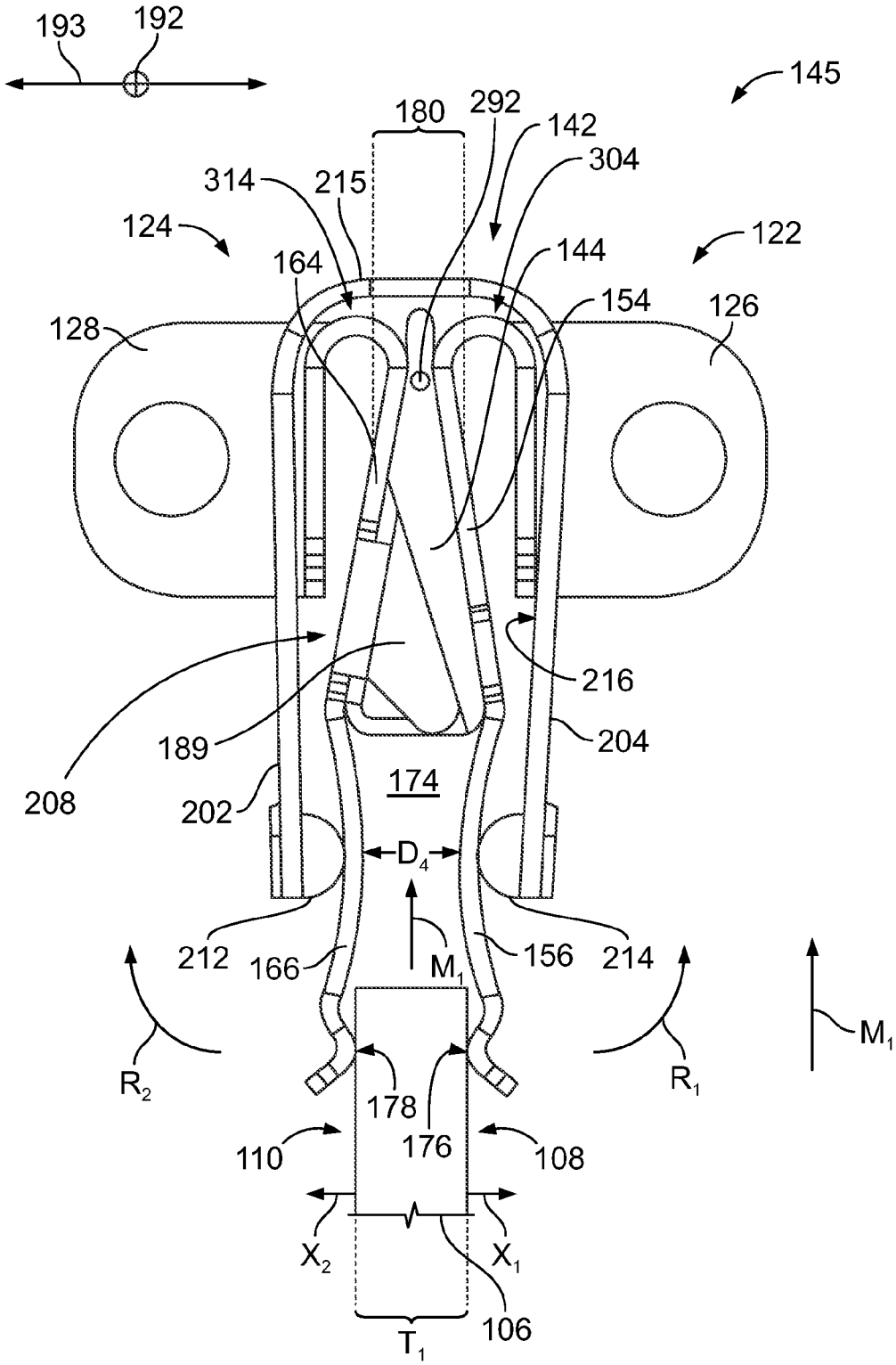
FIG. 8 illustrates a portion of the electrical connector of FIG. 2 during a mating operation.

FIG. 8 is a plan view of the contact assembly 145 that is viewed along the elevation axis 192 during a mating operation with the conductive component 106. When the electrical connector 104 (FIG. 1) is operational, the electrical contacts 122, 124 are located adjacent to each other and have the cavity space 180 therebetween. More specifically, the cavity space 180 exists between the body portions 154, 164 and the mating portions 156, 166. The insulative partition 144 is located within the cavity space 180 between the electrical contacts 122, 124. As shown, the grip element 189 engages a top surface of the insulative partition 144.

During the mating operation, the conductive component 106 is inserted into the component-receiving space 174 and advanced along the mating direction $M_1$. The thickness $T_1$ of the conductive component 106 is greater than a spacing $D_4$. When the conductive component 106 is inserted into the component-receiving space 174, the mating portions 156, 166 engage the sides 108, 110, respectively, and are deflected away from each other along the lateral axis 193. In an exemplary embodiment, the spring clip 142 is configured to mechanically engage (e.g., grip) the mating portions 156, 166 when the mating portions 156, 166 are deflected away from each other. For example, the opposing clip arms 204, 202 are biased at predetermined positions and press against the mating portions 156, 166, respectively, when the mating portions 156, 166 are deflected. As such, the clip arms 204, 202 provide a compressive force against the sides 108, 110 by holding the mating portions 156, 166 against the sides 108, 110, respectively. The mating portions 156, 166 are held against electrically conductive surfaces of the conductive component 106 thereby establishing an electrical connection.

In an exemplary embodiment, a dielectric member is positioned between the spring clip 142 and at least one of the electrical contacts 122, 124 to electrically isolate the spring clip 142 from the electrical contacts 122, 124. For example, at least one of the dielectric pads 214, 212 or the insulative layer 216 may be positioned between the clip body 215 and the respective electrical contact 122, 124. In an exemplary embodiment, each of the dielectric pads 214, 212 is configured to directly engage a corresponding one of the mating portions 156, 166, respectively. The insulative layer 216 is also configured to prevent an electrical connection between the clip body 215 and the electrical contacts 122, 124. For example, if either one of the rear ends 304, 314 of the electrical contacts 122, 124 engage the spring clip 142, the insulative layer 216 prevents the establishment of an electrical connection. Accordingly, the electrical contacts 122, 124 are electrically independent from each other when the mating portions 156, 166 are mechanically engaged by the spring clip 142.

In an exemplary embodiment, the spring clip 142 is configured to move relative to the mounting portions 126, 128 and/or relative to the connector housing 120 (FIG. 1) when the conductive component 106 is advanced into the component-receiving space 174 and engages the mating portions 156, 166. In particular embodiments, the spring clip 142 moves relative to the mounting portions 126, 128 and/or relative to the connector housing 120 when the conductive component 106 engages the mating portions 156, 166 in a misaligned manner. The spring clip 142 may be part of an adjustment or alignment mechanism that interacts with the electrical contacts 122, 124 so that the mating portions 156, 166 are sufficiently engaged to the conductive component 106. As shown in FIG. 8, the spring clip 142 is permitted to rotate about the axis of rotation 292 that extends substantially perpendicular to the mating direction $M_1$ and parallel to the elevation axis 192. The electrical connector 104 is also configured such that, when the spring clip 142 is moved, the insulative partition 144 can move with the spring clip 142.

For example, if the conductive component 106 was displaced in one direction along the lateral axis 193 as indicated by the arrow $X_1$, the mating portion 156 would receive a greater engagement force than the mating portion 166. In other words, the mating portion 156 would be displaced more than if the conductive component 106 were properly aligned with the electrical contacts 122, 124. In such a case, the deflected mating portion 156 presses against the clip arm 204 thereby causing a force $R_1$ that moves the spring clip 142 in a substantially rotational manner. More specifically, the spring clip 142 will rotate about the axis 292 in a counter-clockwise direction. When the spring clip 142 rotates, the clip arm 202 presses against the mating portion 166 thereby moving the mating portion 166 toward the side 110 of the misaligned conductive component 106.

As another example, if the conductive component 106 was displaced in the other direction along the lateral axis 193 as indicated by the arrow $X_2$, the mating portion 166 would receive a greater engagement force than the mating portion 156. The mating portion 166 would be displaced more than if the conductive component 106 were properly aligned with the electrical contacts 122, 124. In this case, the deflected mating portion 166 presses against the clip arm 202 thereby causing a force $R_2$ that moves the spring clip 142 in a substantially rotational manner. More specifically, the spring clip 142 will rotate about the axis 292 in a clockwise direction. When the spring clip 142 rotates, the clip arm 204 presses against the mating portion 156 thereby moving the mating portion 156 toward the side 108 of the misaligned conductive component 106. Thus, when the conductive component 106 is misaligned in either direction along the lateral axis 193, the movable spring clip 142 operates to hold the mating portions 156, 166 against the sides 108, 110, respectively, of the conductive component 106. During operation, the electrical contacts 122, 124 remain electrically independent.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments, and are by no means limiting and are merely exemplary embodiments. Many other embodiments and modifications within the spirit and scope of the claims will be apparent to those of skill in the art upon reviewing the above description. The scope of the subject matter described and/or illustrated herein should, therefore, be determined with reference to the appended claims, along with the full scope of equivalents to which such claims are entitled. In the appended claims, the terms "including" and "in which" are used as the plain-English equivalents of the respective terms "comprising" and "wherein."Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

What is claimed is:

1. An electrical connector comprising:

a pair of electrical contacts, each of the electrical contacts having a mounting portion that is configured to be mounted to an electrical element and a flexible mating portion that is configured to electrically engage a conductive component, the mating portions of the electrical contacts being separated by a component-receiving space and opposing each other across the component-receiving space; and a spring clip that is configured to mechanically engage the mating portions of the electrical contacts and is movable with respect to the mounting portions, the spring clip having a pair of opposing clip arms and a bridge member that joins the clip arms, the clip arms being separated by a gap with the mating portions positioned therebetween, the clip arms being biased against the corresponding mating portions, wherein the spring clip has a dielectric member that is positioned between the spring clip and at least one of the electrical contacts to electrically isolate the spring clip from said at least one of the electrical contacts.

2. The electrical connector in accordance with claim 1, wherein the dielectric member includes first and second dielectric pads, the first dielectric pad being disposed on one of the clip arms and extending toward one of the mating portions, the second dielectric pad being disposed on the other clip arm and extending toward the other mating portion.

3. The electrical connector in accordance with claim 1, wherein the spring clip includes a clip body and the dielectric member comprises an insulative layer that is attached to a surface of the clip body.

4. The electrical connector in accordance with claim 1, wherein the electrical contacts have a cavity space therebetween, the electrical connector further comprising an insulative partition that is located within the cavity space between the electrical contacts.

5. The electrical connector in accordance with claim 4, wherein the insulative partition is held by the electrical contacts.

6. The electrical connector in accordance with claim 4, wherein the insulative partition moves with the electrical contacts when the conductive component engages the mating portions in a misaligned manner.

7. The electrical connector in accordance with claim 1, further comprising a connector housing having a socket opening that is configured to receive an edge of the conductive component, the electrical contacts positioned in the socket opening such that one of the electrical contacts is configured to engage a first side of the conductive component and the other electrical contact is configured to engage a second side of the conductive component.

8. The electrical connector in accordance with claim 1, wherein the spring clip has a clip body that is stamped from sheet material and formed to include the bridge member and the clip arms, the dielectric member being at least one of a dielectric pad or an insulative layer that is attached to the clip body.

9. The electrical connector in accordance with claim 1, wherein each of the electrical contacts extends longitudinally between front and rear ends and has inner and outer surfaces, the inner surfaces of the electrical contacts facing each other and having an insulative partition located therebetween, the outer surfaces of the electrical contacts facing the spring clip, wherein the dielectric member of the spring clip is configured to engage the outer surfaces of the electrical contacts.

10. The electrical connector in accordance with claim 1, wherein the spring clip moves relative to the mounting portions when the conductive component is advanced into the component-receiving space along a mating direction and engages the mating portions in a misaligned manner, the spring clip being permitted to rotate about an axis that extends substantially perpendicular to the mating direction.

11. The electrical connector in accordance with claim 1, further comprising the electrical element, wherein the electrical contacts are electrically independent from each other and configured to carry different voltages.

12. An electrical connector comprising:

a connector housing having an interior cavity and a socket opening that provides access to the interior cavity, the socket opening configured to receive a conductive component;

a pair of electrical contacts positioned in the interior cavity, each of the electrical contacts having a flexible mating portion that is configured to electrically engage the conductive component proximate to the socket opening, the mating portions being separated by a component-receiving space and opposing each other across the component-receiving space; and a spring clip that is configured to mechanically engage the mating portions of the electrical contacts, the spring clip having a pair of opposing clip arms and a bridge member that joins the clip arms, the clip arms being biased against the mating portions located between the clip arms, wherein the spring clip has a dielectric member that is positioned between the spring clip and at least one of the electrical contacts to electrically isolate the spring clip from the electrical contacts.

13. The electrical connector in accordance with claim 12, wherein the dielectric member includes first and second dielectric pads, the first dielectric pad being disposed on one of the clip arms and extending toward one of the mating portions, the second dielectric pad being disposed on the other clip arm and extending toward the other mating portion.

14. The electrical connector in accordance with claim 12, wherein the spring clip includes a clip body and the dielectric member comprises an insulative layer that is attached to a surface of the clip body.

15. The electrical connector in accordance with claim 12, wherein the electrical contacts have a cavity space therebetween, the electrical connector further comprising an insulative partition that is located within the cavity space between the electrical contacts.

16. The electrical connector in accordance with claim 15, wherein the insulative partition is held by the electrical contacts.

17. The electrical connector in accordance with claim 15, wherein the insulative partition moves with the electrical contacts when the conductive component engages the mating portions in a misaligned manner.

18. The electrical connector in accordance with claim 12, further comprising a connector housing having a socket opening that is configured to receive an edge of the conductive component, the electrical contacts positioned in the socket opening such that one of the electrical contacts is configured to engage a first side of the conductive component and the other electrical contact is configured to engage a second side of the conductive component.

19. The electrical connector in accordance with claim 12, wherein the spring clip has a clip body that is stamped from sheet material and formed to include the bridge member and the clip arms.

20. The electrical connector in accordance with claim 12, wherein the spring clip moves relative to the connector housing when the conductive component is advanced into the component-receiving space along a mating direction and engages the mating portions in a misaligned manner, the spring clip being permitted to rotate about an axis that extends substantially perpendicular to the mating direction.

* * * * *